United States Patent [19]

Vardi et al.

[11] 4,085,721

[45] Apr. 25, 1978

[54] EVAPORATION PURGE CONTROL DEVICE

[75] Inventors: Joseph Vardi; Milton J. Kittler, both of New York, N.Y.

[73] Assignee: Exxon Research & Engineering Co., Linden, N.J.

[21] Appl. No.: 696,535

[22] Filed: Jun. 16, 1976

Related U.S. Application Data

[63] Continuation of Ser. No. 773,480, Nov. 5, 1968, abandoned, and a continuation-in-part of Ser. No. 548,702, May 9, 1966, abandoned.

[51] Int. Cl.[2] ..... F02M 37/00

[52] U.S. Cl. ..... 123/136

[58] Field of Search ..... 123/136, 121

[56] References Cited

U.S. PATENT DOCUMENTS

| | | | |
|---|---|---|---|
| Re. 26,169 | 3/1967 | Hall | 123/136 |
| Re. 26,530 | 3/1969 | Wentworth | 123/136 |
| 3,001,519 | 9/1961 | Dietrich et al. | 123/136 |
| 3,093,124 | 6/1963 | Wentworth | 123/136 |
| 3,352,294 | 11/1967 | Biller et al. | 123/136 |
| 3,456,635 | 7/1969 | Hervert | 123/136 |

*Primary Examiner*—Charles J. Myhre
*Assistant Examiner*—Tony M. Argenbright
*Attorney, Agent, or Firm*—Jack Matalon; Kenneth P. Glynn

[57] ABSTRACT

Hydrocarbon fuel vapors from an internal combustion engine are adsorbed during engine nonoperation on an adsorbent and thereafter desorbed during engine operation by backflowing atmospheric air therethrough and then combusted in said engine. Desorption is initiated and maintained when the total air flow to the engine reaches a predetermined minimum amount.

8 Claims, 5 Drawing Figures

EVAPORATION PURGE CONTROL DEVICE

Figure 1:
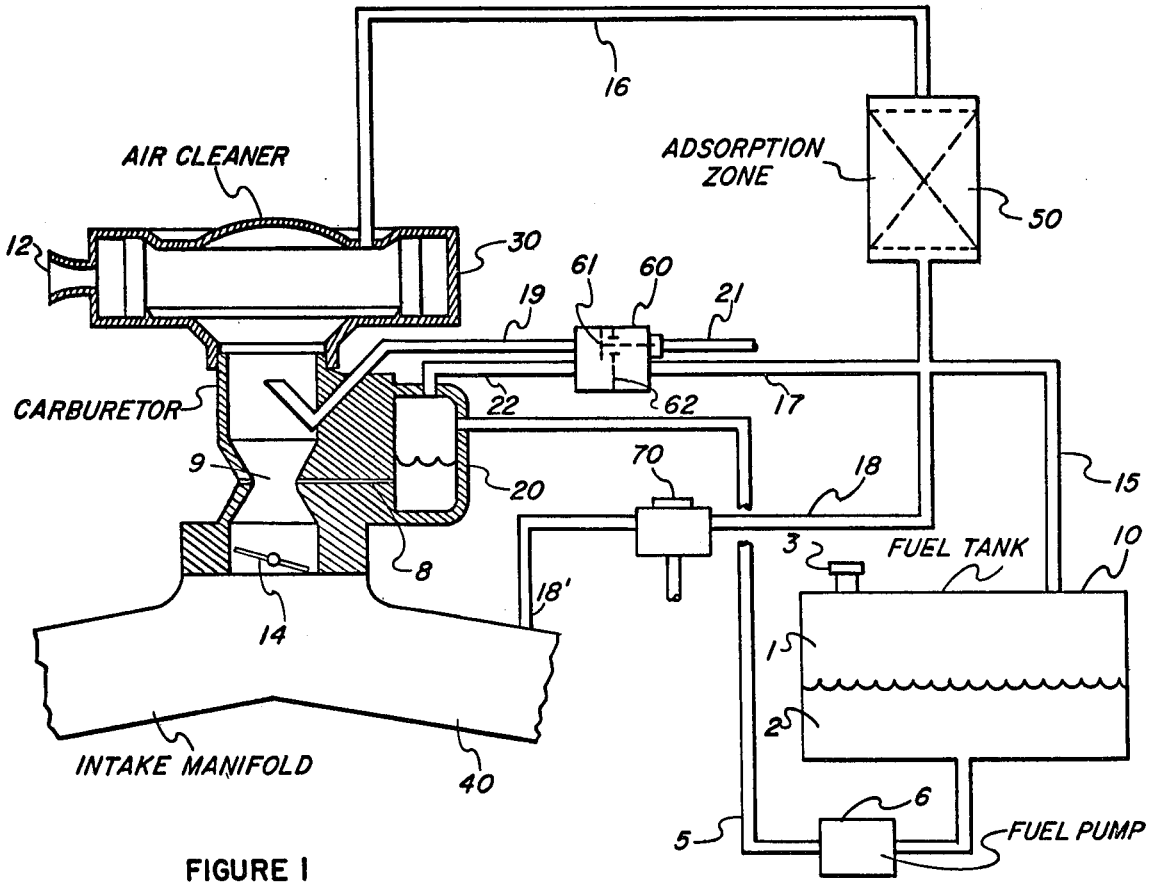

This is a continuation, of application Ser. No. 773,480, filed Nov. 5, 1968, now abandoned, and also a continuation-in-part of Ser. No. 548,702, filed May 9, 1966, entitled "Evaporation Purge Control Device," inventors Joseph Vardi and Milton J. Kittler.

The present invention is broadly concerned with an improved method of operating an internal combustion engine wherein fuel vapors are prevented from venting into and polluting the atmosphere. The invention is also concerned with an improved apparatus or device for attaining this result. A more specific adaptation of the invention is a method of operating the internal combustion engine wherein fuel constituents normally lost to the atmosphere are combusted in the engine to secure greater mileage. In essence, the method and apparatus of the present invention utilize at least one adsorbent bed to adsorb vaporized fuel constituents during engine nonoperation and then desorbs these fuel constituents during engine operation and combusts the same in the engine.

One specific desirable feature of the present process is to desorb the adsorbed constituents at a constant rate or as a function of the amount or rate of air flow into the engine. In this adaptation, as the rate of air flow increases, the rate of desorption increases and, as the amount of air flow decreases, the rate of desorption decreases. This prevents a highly enriched fuel mixture from entering the manifold under conditions which would result in unburned hydrocarbons being passed into the atmosphere. Another specific adaptation of the present invention comprises a novel purge control valve which will function in a manner to better achieve the process described above.

In accordance with another specific adaptation of the present invention, when the engine is idling or operating at relatively low speeds, no air will be backflowed through the adsorption bed and thus no desorption will occur. However, when the amount of intake air to the engine reaches a predetermined minimum, then the control means of the present invention will open, thereby initiating desorption of the adsorbed constituents. The control means will be actuated by the pressure in the exhaust manifold. As the amount of total air flow to the engine increases, the absolute pressure in the exhaust manifold will increase. When this absolute pressure reaches a predetermined minimum, it will function to actuate the control means so as to initiate desorption of the asborbed constituents. The preferred control means comprises a sonic orifice wherein the amount of purge flow is constant and independent of the absolute pressure in the intake manifold.

It is well known that air pollution presents health, nuisance, and economic problems and that the fumes, vapors, and gases evolved from internal combustion motor vehicles contribute significantly to air contamination. It is also known that generally these fumes and vapors are emitted into the atmosphere from the motor vehicle as exhaust gases discharged through the tail pipe, or are due to unburned fuel constituents which are emitted through the vent in the fuel storage tank and through vents from the carburetor bowl. For example, it has been estimated that from about 10 to 20% by volume as, for example, about 15% by volume, of the total vapors and fumes emitted unburned to the atmosphere from an internal combustion motor vehicle, are evaporated from the gasoline tank and the carburetor bowl.

The present invention is particularly concerned with the elimination of fuel losses from the vehicle fuel tank and carburetor bowl and with their ultimate use in the combustion chamber. In accordance with the present invention, fuel vapors, such as hydrocarbon fuel vapors, alcohol vapors, and the like, which are emitted either from the fuel reservoir or the carburetor bowl, are adsorbed on an adsorbent and thereafter desorbed in a controlled varying rate and combusted in the engine. The rate of desorption is either constant or a function of air flow to the engine.

The losses from the fuel reservoir tank are caused by factors which include the rising temperature of the fuel as the vehicle is operated and rising atmospheric temperatures which cause the reservoir or fuel tank to breathe through the vent, or vents, in the fuel tank thereby emitting unburned fuel constituents into the atmosphere. In many instances, the temperature of the fuel reservoir may be from about 20° to 40° F. higher than the atmospheric or ambient temperature.

Furthermore, after the engine has been operated for a period of time and then turned off, the temperature of the fuel in the carburetor bowl rises as heat flows to the carburetor from the hot engine. The fuel is said to undergo a "hot soak." Data have shown that the temperature of the fuel in the carburetor bowl can rise to as high as about 200° F. after the hot engine has been turned off. It has been estimated that the loss per hour from a gasoline tank may range from about 2 to 150 grams and that the "hot soak" loss from the carburetor bowl may range from about 2 to 50 grams per "hot soak."

Thus, in accordance with the present invention as hereinbefore mentioned, those fuel vapors are adsorbed on an adsorbent and then desorbed in a controlled manner and combusted in the internal combustion engine.

The process and apparatus of the present invention may be more fully understood by reference to the drawings illustrating embodiments of the same.

Figure 2:
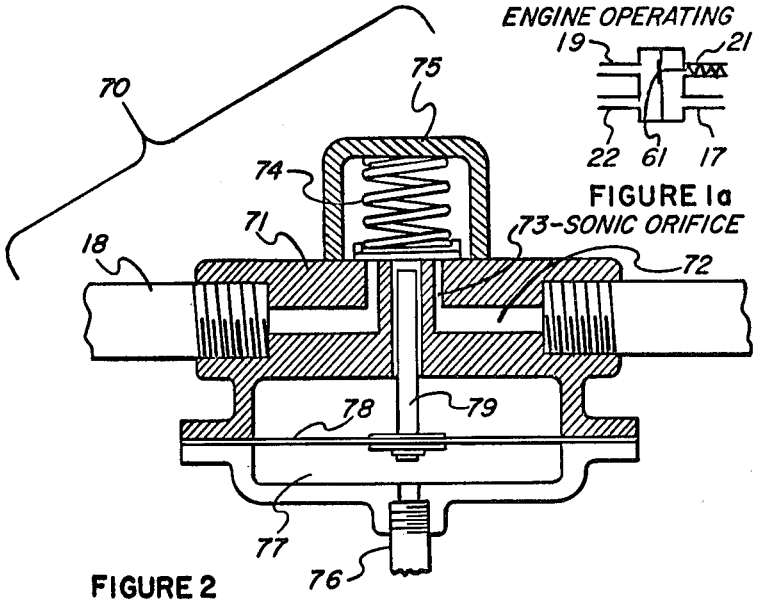

FIG. 1 illustrates the overall apparatus and technique with constant purge flow and on off control, while FIG. 2 illustrates, in some detail, one purge control valve.

Figures 1A, 1B:
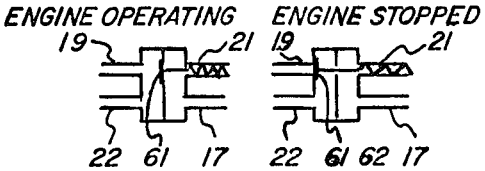

FIG. 1*a* illustrates the position of valve 61 when the engine is operating while FIG. 1*b* illustrates the position of valve 61 when the engine is not operating.

Figure 3:
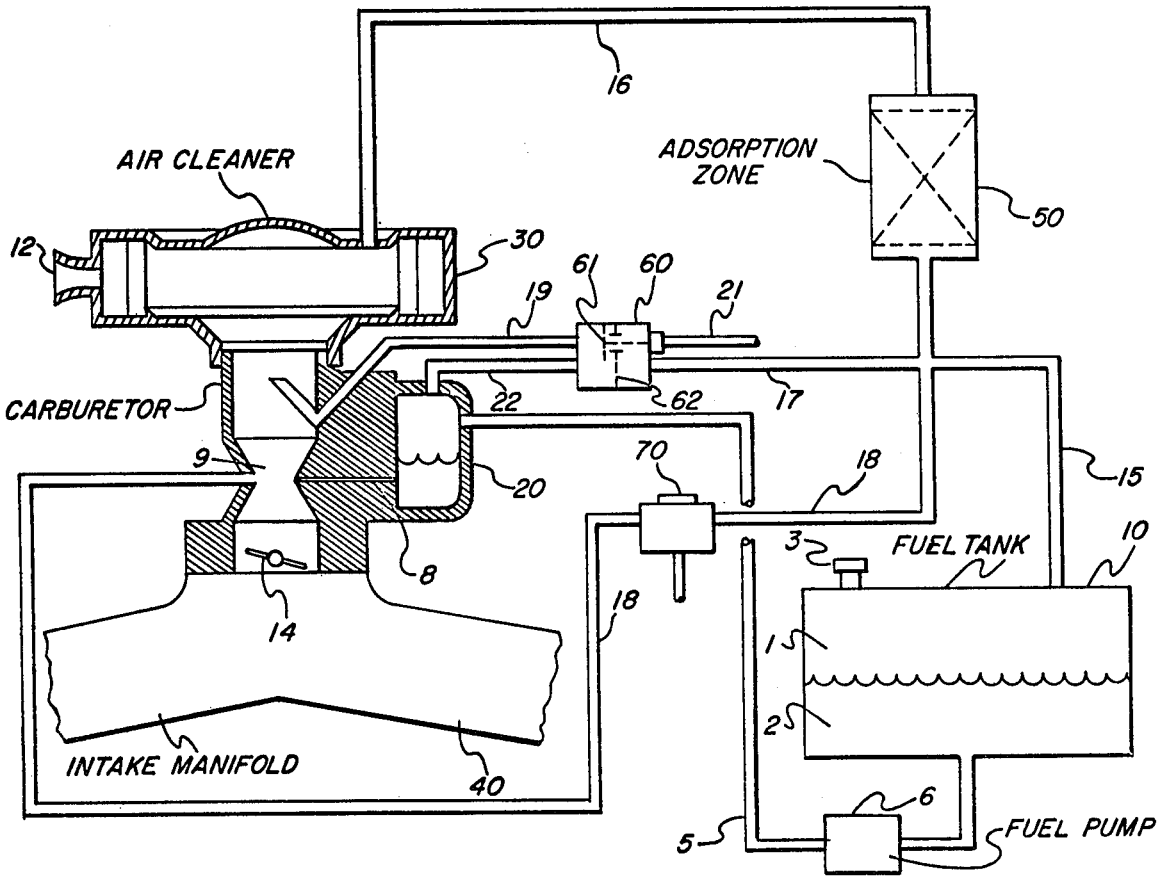

FIG. 3 illustrates an overall apparatus and technique for securing a desorption rate proportional to engine air intake.

Referring specifically to FIG. 1, fuel tank or fuel reservoir 10, has a vapor space 1 and a liquid fuel phase 2. Fuel tank 10 contains a conventional cap 3 permitting fuel to be introduced into the tank 10. Fuel cap 3 also contains a conventional vent which normally permits the tank to breathe whereby expanding vapors are emitted into the atmosphere. In accordance with the present invention the vent in fuel cap 3 is closed off and is vented by means of line 15. The vent on the tank 10 may be placed in other positions. In accordance with one conventional method, liquid fuel is withdrawn from reservoir 10 by means of line 5, fuel pump 6 and introduced into carburetor bowl 20. A conventional float, or equivalent means (not shown) positioned in carburetor bowl 20, controls the level of the liquid fuel in the carburetor bowl. Carburetor bowl 20 is normally supplied with a vent (not shown) which permits vapors to pass into the atmosphere. In accordance with the present invention, gasoline vapors are not permitted to pass into the atmosphere.

In accordance with conventional operation, atmospheric air is introduced by means of line or conduit 12 and passes through air filter 30. The air passes downwardly through the carburetor wherein fuel is withdrawn from bowl 20 by means of line 8 and passed into a carburetion means 9 where the same is mixed with the incoming air. A choke element (not shown) is positioned normally ahead of the carburetion means 9. A flapper valve or element 14 controls the introduction of the fuel-air mixture into the intake manifold 40 which element distributes the fuel-air mixture into the respective cylinders.

As pointed out heretofore, due to temperature variations and fuel tank breathing, fuel vapors pass from the tank 10 through the vent in the tank and internal vents and are lost into the atmosphere thereby causing contamination of the atmosphere. Also as pointed out heretofore, after the engine has been run for a time period, the entire engine block is very hot and when the engine is turned off, the fuel in the carburetor bowl becomes quite warm reaching temperatures as high as 190° F. and greater. This causes a portion of the fuel to be vaporized. The vapors are vented through the carburetor vent and further contaminate the atmosphere. Also, in addition, valuable fuel constituents are lost rather than combusted in the engine.

In accordance with the present invention, the tank vent and the carburetor vent, and any other open vents which would allow loss of vapors from the fuel system to the atmosphere are closed off. A conduit 15 is affixed to the fuel tank to provide communication to one end of an adsorption zone 50. During engine nonoperation, vapors flow through line 15 to the one end of adsorption zone 50. Adsorption zone 50 contains a suitable adsorbent therein for adsorbing vaporous fuel constituents such as activated carbon, silica gel and the like. A line 16 is provided at the other end of adsorption zone 50 which provides communication to the atmosphere, preferably through the air filter. The quantity of adsorbent provided is sufficient to adsorb all vaporous fuel constituents emitted from tank 10 and bowl 20 and to prevent any breakthrough of these constituents through line 16. The quantity of adsorbent required will be a function, among other factors, of the particular engine design, environmental conditions, and particular adsorbent or adsorbent mixture utilized. A preferred adsorbent is activated carbon.

Thus, when the fuel in tank 10 emits vapors due to temperature rise, change in pressure, etc., and when the engine is not operating, these vapors are adsorbed on the adsorbent in adsorption zone 50. Vapors cannot flow through line 18 when the engine is not operating since valve 70 is always closed when the engine is not operating. The operation of valve 70 will be hereinafter described. Also valve 61 closes line 19 thereby preventing flow of any vapors into line 19. Line 81 is always sealed off from area 60. When the engine is not operating, spring means will seat valve 61 so as to prevent communication between line 19 and 60 as illustrated in FIG. 1*b*. When the engine is operating, line 21 being connected with intake manifold 40, will position valve 61 so as to seal the aperture in solid partition 62 as illustrated in FIG. 1*a*. As pointed out heretofore, no communication exists between line 21 and the area within valve assembly 60. When the engine is operating, the suction pressure or vacuum in manifold 40 not only will draw atmospheric air into air filter zone 30 but also will draw air in through line 16, zone 50, conduit 18, and into manifold 40. This will backwash or backflow air through adsorption zone 50 from the other end to the one end in a manner to desorb the fuel constituents which were adsorbed previously on the adsorbent. As pointed out heretofore, the amount of adsorbent provided is sufficient so that when fuel constituents are being adsorbed, none of these fuel constituents will pass into the atmosphere by means of line or vent 16. The amount of backwash air passed through vent 16 is sufficient to desorb the previously adsorbed fuel constituents.

Referring to the carburetor bowl 20 when the engine is turned off after running, fuel constituents will vaporize and flow through line 22 and preferably through a pressure balance valve 60, through line 17 and into one end of adsorption bed 50 which, as pointed out, is provided with an adsorbent which will adsorb the vaporized fuel constituents. (See FIG. 1*b*.) When the engine is not operating, valve 61 will seal off line 19. (See FIG. 1*b*.) Therefore, vapors will flow from bowl 20, through line 22, through the aperture in partition 62 and through line 17 into the one end of zone 50. As pointed out heretofore, line 21 is sealed off from area 60. Sufficient adsorbent is provided so as to prevent any breakthrough of the fuel constituents into line or conduit 16 provided near the top or at the other end of zone 50. Line 19 provides communication between the carburetor and the pressure balance valve 60. Line 21 provides communication between the balance valve 60 and the intake manifold. Pressure balance valve 60 is a mechanism which functions in a manner that when the engine is operating, free communication will be provided between the carburetor through line 19, through valve 60 and through line 22 to the vaporous area in the carburetor bowl. This results in a very desirable pressure balance between these two areas. This operation is secured by the suction pressure in the manifold intermediate through line 21 to actuate against a spring load valve in a manner to seat valve 61 in the port of divider 62. When the engine is not operating, suction pressure is released on line 21 and the spring will then seat valve 61 to seal off line 19. Thus, free communication is secured from the carburetor bowl 20 through line 22, through valve 60, through line 17 and into canister element 50. Therefore any constituents vaporizing from the carburetor cup will be adsorbed or the adsorbent. Thus, as illustrated in FIG. 1, vapors from tank 10 and carburetor bowl 20 are adsorbed on the adsorbent in zone 50 when the engine is not operating. These vapors are then desorbed by backflowing air through line 16, through zone 50 and line 18 into the manifold 40.

In accordance with a preferred and specific adaptation of the present invention, a purge control valve 70 is positioned in the conduit 18 intermediate the adsorbent and the intake manifold. This valve is designed to close during periods when the engine is idling and when it is being deaccelerated. As illustrated, the valve is actuated by the pressure on the exhaust manifold.

Generally, the valve will close at low exhaust back pressure, 0–10 inches of water, or when the air intake through the carburetor in low. The valve will open when the exhaust back pressure is increased. For a specified car (specified engine and exhaust system) the value of the minimum exhaust back pressure used to open the valve is chosen according to a certain desirable speed of the car. The latter speed is the minimum speed suitable to introduce the purged hydrocarbons from the canister.

By operating in this manner an enriched fuel secured by desorption of the adsorbent will not be permitted to enter the intake manifold and thus cause loss of these unburned fuel constituents into the atmosphere.

Referring specifically to FIG. 2 which illustrates one type of a purge control valve in some detail, lines similar to the lines illustrated in FIG. 1 are similarly numbered. Purge valve assembly 70 comprises an intake conduit 71 communicating with line 18 and an outlet conduit 72 communicating with line 18 which communicates with the intake manifold 40. Conduits 71 and 72 are interconnected by means of a sonic orifice 73 which permits flow of air therethrough whenever it is opened to any extent. Since a sonic orifice is used, the purge flow is constant and independent of the absolute pressure in the intake manifold. The $\Delta P$ across the adsorption bed is not affected by engine air intake. Spring element 74 in a suitable housing 75 comprises part of the orifice assembly. When the pressure in exhaust manifold changes after periods of idleness or deacceleration, this pressure is transmitted through line 76 to increase the pressure in area 77 of the purge control valve. Under these conditions membrane 78 is forced upwardly pushing piston 79 upwardly in a manner to actuate the valve thereby opening or closing the same under predetermined conditions. Thus, when the absolute exhaust pressure in the exhaust manifold reaches a predetermined minimum figure, which is a function of total air flow to the engine, valve 70 will open and will thus initiate desorption of the adsorbed constituents in zone 50.

The operation of this valve is controlled by exhaust back pressure which is taken off the exhaust manifold. When the exhaust back pressure reaches some predetermined level, the diaphragm moves vertically toward the valve seat. In such a movement, the shaft extending from the diaphragm also moves up, unseating the elastomeric valve seat. When this valve seat is unseated, intake manifold vacuum sucks purge air through the sonic orifice (on the downstream side of the valve) and the canister stripping operation begins. It is clear that this valve's operation is a functionof engine mixture throughput (which is exponentially related to exhaust back pressure). Under idle or deceleration conditions, in which engine throughput is very low, the diaphragm and shaft drop, and the spring on top of the valve seat instantly forces the seat into place, cutting off purge flow. By this means, the stripping of the canister can be phased to engine operation.

Reference is made to FIG. 3 illustrating an embodiment of the present invention wherein the rate of desorption is proportional to engine air intake. Thus, as the amount of air to the engine increases, the $\Delta P$ across the adsorption bed will increase. Elements of FIG. 3 similar to elements of FIG. 1 are similarly numbered and function similarly except as hereinafter described.

Control valve 70 of FIG. 3 does not contain a sonic orifice 73. However, the amount of purge flow may be controlled by an orifice 73. Line 18' extends from valve 70 to the carburetor throat 9 rather than into the intake manifold 40. Since line 18' is connected to the carburetor venturi, the greater the flow, the greater the vacuum, thus increasing the $\Delta P$ across the adsorption bed 50. This, in effect, will increase the rate of desorption as the rate of total airflow to the engine increases. As the rate of airflow to the engine decreases, the $\Delta P$ across the bed will decrease thus reducing the rate of desorption.

Under certain conditions, it is possible to eliminate valve 70, as illustrated in FIG. 3, entirely.

Thus, the present invention is concerned with a technique for the adsorption of hydrocarbon vapors from the fuel tank and from the carburetor bowl in a bed of adsorbent generally during periods when the engine is not operating. During engine operation these vaporous constituents are desorbed from the adsorbent and combusted in the engine. The rate of desorption is a function of the rate of air flow to the engine. When there exists a high rate of air flow to the engine, the constituents will be desorbed at a high rate by the passage through the bed of greater quantities of air. As pointed out heretofore, if the engine is idling under certain conditions no desorption of the constituents will occur. This, in effect, secures a very efficient operation and minimizes to the utmost loss of unburned constituents into the atmosphere.

As pointed out heretofore, one method of attaining this result is illustrated by the purge control valve of FIG. 2. Other equivalent mechanisms may be used in a manner to secure the rate of desorption as a function of rate of air flow to the engine. FIG. 2 illustrates an adaptation wherein the signal is picked up from the exhaust back pressure and transmitted through a membrane valve assembly. Thus, the back pressure can be used directly to open an off-on mechanical valve or to activate an off-on switch in a pressure sensor. The switch may be connected to a solenoid valve arrangement. The solenoid is then activated according to the position of the switch. With the type of mechanism described in FIG. 2, valve means 70 will open when the exhaust manifold pressure reaches a predetermined mean amount which will thereby initiate desorption of the adsorbed constituents.

What is claimed is:

1. In a fuel vapor recovery process for an internal combustion engine fuel system including adsorption means for adsorbing and storing fuel vapor otherwise released to the atmosphere from the engine fuel system, the steps comprising:

(a) desorbing said adsorption means of stored fuel vapors by passing atmospheric air therethrough;

(b) directing said atmospheric air and desorbed fuel vapors to said internal combustion engine for combustion therein; and (c) controlling as a function of exhaust manifold pressure, the flow of atmospheric air through said adsorption means to permit desorption of said adsorption means only when the total air intake throughput to said engine exceeds a predetermined minimum amount substantially greater than that which occurs during engine idle, whereby stored fuel vapors from said adsorption means are combusted in said engine under optimum conditions of engine operation to minimize the amount of unburned fuel in the engine exhaust.

2. In a fuel vapor recovery system for an internal combustion engine fuel system including adsorption means for adsorbing and storing fuel vapor otherwise released to the atmosphere from the engine fuel system, the improvement comprising:

(a) means for passing atmospheric air through said adsorption means to desorb stored fuel vapors from said adsorption means;

(b) means for directing said atmospheric air and desorbed fuel vapors to said internal combustion engine for combustion therein; and (c) control means responsive to engine air intake throughput to permit desorption of said adsorption means to occur only when said air intake throughput to said engine exceeds a predetermined minimum amount substantially greater than that which occurs during engine idle, whereby stored fuel vapors from said adsorption means are combusted in said engine under optimum conditions of engine operation to minimize the amount of unburned fuel in the engine exhaust, as a function of exhaust manifold pressure.

3. The fuel vapor recovery system of claim 2 including:

(a) a fuel reservoir;

(b) adsorption means having one end and another end, and containing an adsorbent therein, said other end being in communication with the atmosphere;

(c) an engine intake manifold communicating with the cylinders of said engine;

(d) a first conduit in communication with said one end of said adsorption means and the vapor area of said fuel reservoir;

(e) a second conduit in communication with said engine intake manifold and said one end of said adsorption means;

(f) valve means positioned in said second conduit; and (g) control means for said valve means to close said second conduit during engine idle and thereby prevent any desorption of said adsorption means whereby unburned fuel constituents emitted into the atmosphere from said engine are minimized.

4. The system of claim 3 in which said second conduit extends directly from said valve means to said intake manifold.

5. The system of claim 3 wherein said second conduit extends directly from said valve means to the throat of the carburetor of said engine.

6. A process for operating an internal combustion engine which comprises adsorbing vaporous fuel constituents evolved from a liquid fuel reservoir on an adsorbent during engine nonoperation, and during engine operation backflowing atmospheric air through said adsorbent to desorb adsorbed constituents, said backflowing of air through said adsorbent to desorb adsorbent constituents being controlled as a function of exhaust manifold pressure.

7. The process of claim 6 wherein the backflowing of atmospheric air occurs only when the pressure in the exhaust manifold exceeds a finite number greater than zero inches of water but equal to or less than ten inches of water.

8. Apparatus for preventing loss of fuel constituents into the atmosphere from an internal combustion engine which comprises in combination: (1) a fuel reservoir; (2) an adsorption zone having a one end and another end, and containing an adsorbent therein, said other end being in communication with the atmosphere; (3) an engine intake manifold communicating with the cylinders of said engine; (4) a first conduit in communication with said one end of said adsorption zone and the vapor area of said fuel reservoir; (5) a second conduit in communication with said engine intake manifold and said one end of said adsorption zone; (6) valve means positioned in said second conduit; and (7) control means for said valve means to close said second conduit during engine idle and deceleration and thereby prevent any desorption of said adsorption zone whereby unburned fuel constituents emitted into the atmosphere from said engine are minimized; (8) a third conduit is in communication with said valve means and with (9) an exhaust manifold in a manner that the change in pressure in said exhaust manifold will function to open and close said valve means.

* * * * *